United States Patent [19]

Jeremic

[11] Patent Number: 4,903,557

[45] **Date of Patent: * Feb. 27, 1990**

[54] ADJUSTABLE WRENCH

[76] Inventor: Miodrag Jeremic, 405 - 310 Alexander Street, Vancouver, British Columbia, Canada, V6A 1C4

[ * ] Notice: The portion of the term of this patent subsequent to Aug. 30, 2005 has been disclaimed.

[21] Appl. No.: 287,028

[22] Filed: Dec. 21, 1988

[30] Foreign Application Priority Data

Aug. 30, 1988 [CA] Canada ..... 576094

[51] Int. Cl.[4] ..... B25R 13/16

[52] U.S. Cl. ..... 81/166

[58] Field of Search ..... 81/165–168, 81/177.1, DIG. 1

[56] References Cited

U.S. PATENT DOCUMENTS 1,522,091 9/1925 Thewes ..... 81/167 X
2,613,567 10/1952 Tenerowicz et al. ..... 81/166 X
4,766,786 8/1988 Jeremic ..... 81/166 X

FOREIGN PATENT DOCUMENTS 244119 4/1943 Switzerland ..... 81/166
301884 1/1929 United Kingdom ..... 81/166

*Primary Examiner*—James G. Smith
*Attorney, Agent, or Firm*—Murray E. Thrift; Stanley G. Ade; Adrian D. Battison

[57] ABSTRACT

An open adjustable wrench has an aligned handle and C-shaped head, the head being opened to the side. A moveable key slides in the head axially of the handle towards and away from a fixed gripping face on the upper end of the head. The key is adjusted in position by a threaded stem sliding in the keyway and itself advanced and retracted by rotation of a nut. The key and stem are detachably connected so that they can be removed from the wrench head for maintenance or replacement.

17 Claims, 2 Drawing Sheets

10
11A
11
12
3
11B
11C
13
20A
19
9
9A 13
19
6
6A
32

33
31

20A
3
14
20B
20
22
30
30A
25
21
24
21
26
28
1
17
18
4
20A
20A
20B
20B
30
30A
22
8
23
26
1
17
18
7
33

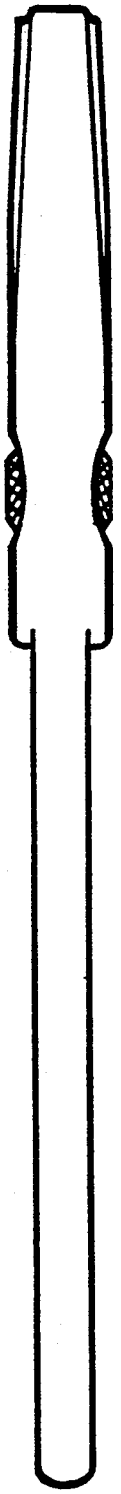
FIG. 4.
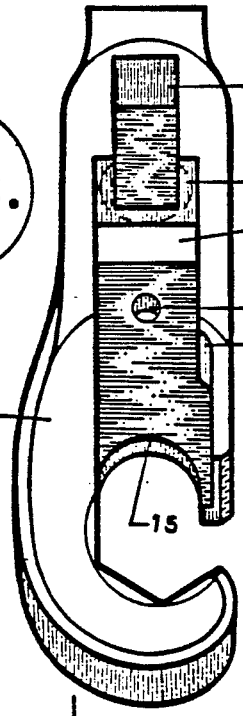
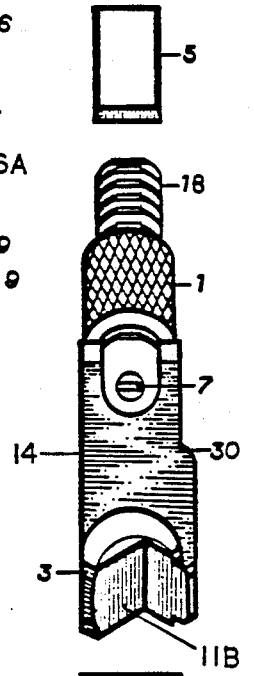
FIG. 5.
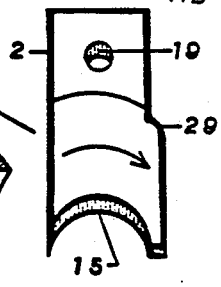
FIG. 6.
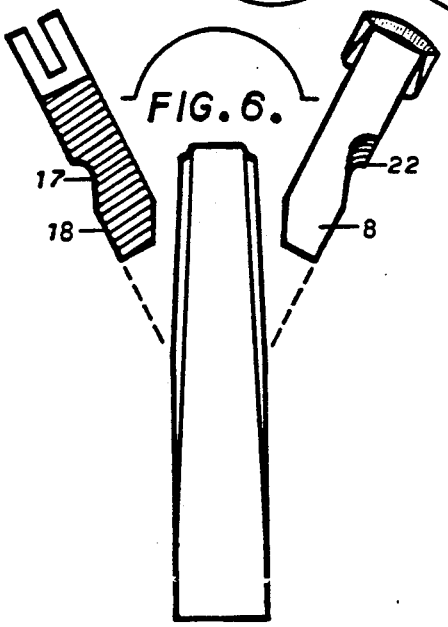

ADJUSTABLE WRENCH

FIELD OF THE INVENTION

A present invention relates to adjustable wrenches of the open type.

BACKGROUND OF THE INVENTION

Most adjustable wrenches of the open type have a fixed jaw and a moveable jaw that projects from the handle and slides towards and away from the fixed jaw. This arrangement produces a torque on the moveable jaw that can damage or loosen its slide arrangement, causing mis-alignment of the jaws and insecure gripping of a fastener to be turned.

The present invention is concerned with an alternative form of adjustable, open wrench and with certain specific characteristics of its construction.

SUMMARY OF THE INVENTION

According to the present invention there is provided an adjustable wrench comprising:

a handle extending along a wrench axis;

a C-shaped wrench head at one end of the handle end defining a gripping cavity open to one side of the wrench head for receiving objects therein, the gripping cavity including a gripping face facing towards the handle, and an axial keyway in the wrench head opening into the gripping cavity opposite the gripping face;

a key slideable in the axial keyway with a second gripping face confronting the gripping face of the cavity;

key adjustment means including a threaded stem axially and non-rotatably slideable in the axial keyway and a nut threaded onto the stem, the nut extending to the outside of the wrench head through an opening therein such that the nut may be rotated manually to advance or retract the stem in the axial keyway; and means for detachably connecting the key and the stem.

The key is thus bodily captive in a keyway, rather than being cantilevered from the handle. This eliminates the large moment arm between the reaction forces on the moveable jaw and its sliding support that is found in the prior art wrenches.

In order to provide a moveable gripping face that is the same width as the fixed gripping face, the key may have lips projecting from its opposite faces to extend the width of the moveable gripping face beyond the width of the keyway. The lips preferably nest into suitably shaped edges of the gripping cavity beside the keyway.

In order to enable the servicing of the wrench the key and the adjustment mechanism are separable and removeable from the wrench. To allow removal of the key, it has a bevelled edge along the gripping face, a bevelled surface at one side on the attachment end, and a notch in the opposite side that mates with the edge of the cavity beside the keyway. This allows the key to be tipped out of the cavity and pulled from the keyway. A similar bevel and notch arrangement may be provided on the threaded stem.

A particularly advantageous characteristic is a series of belt holes spaced along the wrench handle. These are holes that increase in length from the wrench head towards the end of the wrench so as to accommodate belts of different widths. A wrench having belt holes of this sort may be belted to the body, possibly beneath a coverall, and safely carried to locations that are difficult to reach, with no danger of losing the wrench or dropping it from high places, thus creating a safety hazard for persons below.

The wrench body is preferably formed in two pieces, a handle piece and a head piece, each forged. The keyway is forged into the head part as a cavity open to one side and then is closed with two plates, welded in place. The head and handle are also assembled by welding.

BRIEF DESCRIPTION OF THE DRAWINGS

In the accompanying drawings, which illustrate an exemplary embodiment of the present invention:

FIG. 4 is a side view of the wrench;

FIG. 5 is an exploded view of the wrench head from the front, with the covers shown removed; and FIG. 6 illustrates the manner in which the key and the threaded stem are withdrawn from the wrench through the gripping cavity.

DETAILED DESCRIPTION

Figures 1, 2, 3:
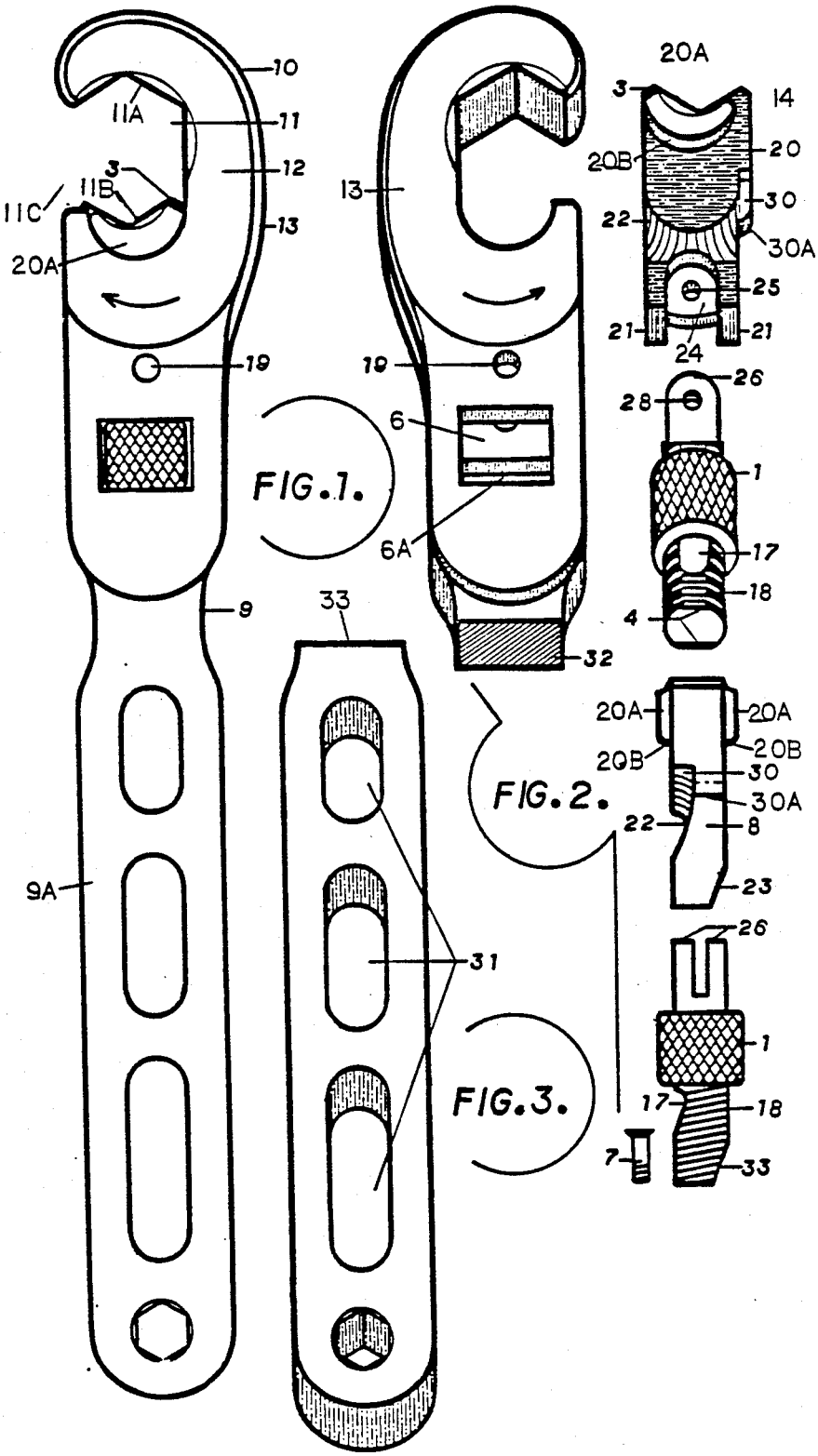
FIG. 1 is a front elevation of the wrench.
FIG. 2 is an exploded rear view of the wrench head.
FIG. 3 is a rear view of the wrench handle

Referring to the accompanying drawings, there is illustrated a wrench 9 with a wrench head 10 and a handle 9A. The handle and head are aligned with one another, the head being a continuous extension along the axis of the handle. The head has a gripping cavity 11 with a fixed gripping face 11A configured as two flats with an included angle of 120°. This confronts a moveable gripping face 11B of a similar configuration on a moveable key 14. Between the two gripping faces 11A and 11B, the wrench has an open side 11C so that objects to be gripped by the wrench can be inserted sideways into the gripping cavity.

The wrench head has a front face 12 illustrated in FIG. 1 and a rear face 13 illustrated in FIG. 2. These faces are mirror images of one another.

A keyway 6, most clearly illustrated in FIG. 5, extends axially along the wrench head and opens into the gripping cavity opposite the fixed gripping face 11A. On opposite sides of the keyway 6 the gripping cavity is bounded by an arcuate, concave edge 15. The keyway 6 is rectangular in section, as is most clearly evident from FIG. 5. An outer section of the keyway adjacent the cavity 11 is slightly wider from side to side than the edges 15, and a middle section of the keyway is substantially the same width from side to side as the curved edges 15. These two sections meet at a concave shoulder 29 on that side of the wrench adjacent the opening 11C. At the bottom, the keyway has a section 16 that is still smaller in cross-sectional dimension. Immediately above the section 16, there is a rectangular opening 6A in the faces 12 and 13 of the wrench.

The key 14 has a body 20 of a generally rectangular form, although on one side there is a curved shoulder 30A that is shaped to mate with the shoulder 29 in the keyway 6. The end face of the key is formed into the gripping face 11B as previously mentioned and adjacent that face the body has two lips, projecting from the opposite faces of the key to extend the gripping face 11B to the same width as the gripping face 11A The lips 20A have lower surfaces 20B that mate with the arcuate, concave edges 15 of the gripping cavity. The edges 15 and surfaces 20B are arranged symmetrically on the axis of the keyway, while the gripping faces 11A and 11B are offset slightly towards the opening 11C of the cavity 11.

At the lower, attachment end of the key 14 are two spaced lugs 21 joined by a web 24. The web has a central bore 25. Along the edge of the gripping face 11B that is most remote from the wrench opening 11C, the key has a bevelled face 3 extending from face to face. The key also has a bevelled surface 23 at the attachment end extending from side to side. An arcuate notch 22 is formed in the face of the key opposite the bevelled surface 23 and is shaped to engage over the edge 15 of the cavity 11. Adjacent the shoulder 30A, the notch extends into a recess 30 extending upwardly from the shoulder 30A.

The adjustment mechanism includes a threaded stem 18 with two lugs 26 on its upper end. The lugs fit on opposite sides of the web 24 with bores 28 in the lugs in alignment with the bore 25 of the web. The parts are held together by a screw 7 or a pin through the bores.

The stem 18 has a pair of opposed flats 4 that slide along the opposite faces of the keyway, thus preventing rotation of the stem in the keyway. The stem has a bevelled surface 33 adjacent its lower most end, at one of the flats, and a notch 17 on the opposite flat spaced above the lower end. The threaded stem carries a nut 1 that, in use, projects from the openings 6A in the faces 12 and 13 of the wrench head. The nut is captive in the openings 6A so that rotation of the nut will advance and retract the threaded stem 18 and with it the key 14 along the keyway 6. The flats 4 on the threaded stem slide on the side faces of the keyway to prevent rotation of the stem as the nut is rotated.

In order to allow separation of the key and the stem, the wrench had is provided with access ports 19 on its opposite sides so that the stem and key can be positioned with the screw 7 in alignment with the access ports, allowing removal of the screw. Once the key 14 has been disconnected from the stem 18, the key can be extended fully into the cavity 11 so that the notch 22 is in line with the adjacent cavity edge 15. The key may then be pushed to the side containing the notch 22, the notch and the bevel 23 on the opposite side permitting this rocking movement inside the keyway 6, while the bevel 3 at the gripping face 11D provides adequate clearance with respect to the gripping face 11A. The key may then be pulled from the cavity 11 as illustrated in FIG. 6.

To remove the stem, the nut 1 is rotated to drive the stem 18 towards the cavity 11. When the stem clears the nut, the nut can be removed sideways through the openings 6A and the stem moved manually up to a position where the notch 17 confronts the adjacent cavity edge 15. The stem can then be pivoted about the edge of the notch much in the same way as the key and extracted. The bevelled surface 33 provides the necessary clearance, much in the same way as the bevelled surface 23 on the key.

The manufacture of the wrench involves the forging of the handle 9A as illustrated in FIG. 3 and the forging of a head piece 10A as illustrated in FIG. 5. The keyway 6 in this forging is a channel open to one side of the forging. To complete the wrench head, a cover 2 is welded in place over the keyway above the opening 6A and a smaller cover 5 is welded in place over the keyway to enclose the section 16. The end face 32 of the head is then welded to the end face 33 of the handle.

Referring to FIG. and 2, the handle is equipped with three belt holes 31 that increase in length from the head towards the end of the handle. The belt holes are all of uniform width. These holes will accommodate belts of any width. They are used to strap the wrench to a user, possibly under a set of coveralls, so that the wrench can be carried, without use of hands and with no danger of the wrench falling out of a pocket or loop. This is of importance where the person using the wrench is involved in such activities as climbing ladders, where both hands ar necessarily involved in the climbing activity and the loss of a tool could be a danger to the persons below.

While one embodiment of the invention has been described in the foregoing, it is to be understood that other embodiments are possible within the scope of the invention. The invention is to be considered limited only by the scope of the appended claims.

I claim:

1. An adjustable wrench comprising:

a handle extending along a wrench axis;

a C-shaped wrench head at one end of the handle end defining a gripping cavity open to one side of the wrench head for receiving objects therein, the gripping cavity including a gripping face facing towards the handle, and an axial keyway in the wrench head opening into the gripping cavity opposite the gripping face;

a key slideable in the axial keyway with a second gripping face confronting the gripping face of the cavity;

key adjustment means including a threaded stem axially and non-rotatably slideable in the axial keyway and a nut threaded onto the stem, the nut extending to the outside of the wrench head through an opening therein such that the nut may be rotated manually to advance or retract the stem in the axial keyway; and means for detachably connecting the key and the stem.

2. A wrench according to claim 1 wherein the key has lips extending to opposite faces of the wrench head, with an end face of each lip defining a portion of the second gripping face of the key.

3. A wrench according to claim 2 wherein the lips have convex lower faces and the gripping cavity has concave edges on opposite sides of the axial keyway, mating with the convex lower faces of the lips.

4. A wrench according to claim 3 wherein the key has a convex notch on one face thereof spaced below the lip on that face and configured to engage over the concave edges of the gripping cavity.

5. A wrench according to claim 4 wherein the key has a bevelled surface at an attachment end thereof, on a second face opposite the one face.

6. A wrench according to claim 5 wherein the key has a bevelled edge along the side of the second gripping face furthest from the opening in the side of the wrench head.

7. A wrench according to claim 1 wherein the threaded stem includes a pair of opposed flat sides engaging slideably with flat sides of the axial keyway thereby to prevent rotation of the stem in the passage.

8. A wrench according to claim 7 wherein the stem has a bevelled surface between a first one of the flat sides and a bottom end thereof.

9. A wrench according to claim 8 wherein the stem has a notch on the opposite second one of the flat sides, spaced above the bevelled surface.

10. A wrench according to claim 1 wherein the means for detachably connecting the key and the stem comprise a web on the attachment end of the key, a pair of lugs on the attachment end of the stem for receiving the web therebetween, aligned bores in the web and the lugs and a fastener extending through the aligned bores.

11. A wrench according to claim 10 wherein the fastener is a pin.

12. A wrench according to claim 10 wherein the fastener is a screw.

13. A wrench according to claim 10 including an access port in the wrench head allowing removal of the fastener.

14. A wrench according to claim 1 including belt holes in the wrench handle, spaced therealong.

15. A wrench according to claim 14 wherein the belt holes are of different sizes.

16. A wrench according to claim 15 wherein the belt holes have increasing lengths from the wrench head towards the end of the handle.

17. A wrench according to claim 16 wherein the belt holes have substantially the same width.

* * * * *